US012760438B2

(12) United States Patent
Huo

(10) Patent No.: US 12,760,438 B2
(45) Date of Patent: Oct. 13, 2026

(54) ELECTROPLATING CONDUCTIVE FIXTURE

(71) Applicants: CHIPMORE TECHNOLOGY CORPORATION LIMITED, Suzhou (CN); HEFEI CHIPMORE TECHNOLOGY CO., LTD., Heifei (CN)

(72) Inventor: Jisheng Huo, Suzhou (CN)

(73) Assignees: CHIPMORE TECHNOLOGY CORPORATION LIMITED, Suzhou (CN); HEFEI CHIPMORE TECHNOLOGY CO., LTD., Heifei (CN)

( * ) Notice: Subject to any disclaimer, the term of this patent is extended or adjusted under 35 U.S.C. 154(b) by 476 days.

(21) Appl. No.: 18/294,265

(22) PCT Filed: Nov. 23, 2021

(86) PCT No.: PCT/CN2021/132282

§ 371 (c)(1),
(2) Date: Feb. 1, 2024

(87) PCT Pub. No.: WO2023/015768

PCT Pub. Date: Feb. 16, 2023

(65) Prior Publication Data

US 2024/0254647 A1 Aug. 1, 2024

(30) Foreign Application Priority Data

Aug. 11, 2021 (CN) ..... 202110920641.9

(51) Int. Cl.
*C25D 17/00* (2006.01)

(52) U.S. Cl.
CPC ..... *C25D 17/005* (2013.01)

(58) Field of Classification Search
CPC ..... C25D 17/005
See application file for complete search history.

(56) References Cited

U.S. PATENT DOCUMENTS 4,441,976 A 4/1984 Lemmi et al.
5,462,649 A 10/1995 Keeney et al.
(Continued)

FOREIGN PATENT DOCUMENTS

CN 205838630 U 12/2016
CN 206768254 U 12/2017
(Continued)

OTHER PUBLICATIONS

International Search Report (PCT/ISA/210) issued in PCT/CN2021/132282 mailed on May 13, 2022.

*Primary Examiner* — Luan V Van
(74) *Attorney, Agent, or Firm* — Birch, Stewart, Kolasch & Birch, LLP

(57) ABSTRACT

The present invention provides an electroplating conductive fixture, comprising a base, a top cover and a conductive column. The bottom of the conductive column penetrates the base. A first guide part is arranged on the base. A second guide part is arranged on the conductive column. At least one of the first guide part and the second guide part extends in the shape of spiral from bottom to top. The bottom of the conductive column is provided with a scraper. In the present application, the scraper at the bottom of the conductive column is used to clean crystals on a conductive piece, which ensures good contact and improves the stability of a current and voltage during an electroplating process.

10 Claims, 7 Drawing Sheets

(56) References Cited

U.S. PATENT DOCUMENTS

| | | | |
|---|---|---|---|
| 10,958,013 | B1 | 3/2021 | Peng et al. |
| 2018/0291521 | A1 | 10/2018 | Tsuji et al. |

FOREIGN PATENT DOCUMENTS

| | | | |
|---|---|---|---|
| CN | 207588024 | U | 7/2018 |
| CN | 209779023 | U | 12/2019 |
| CN | 209798146 | U | 12/2019 |
| CN | 209974940 | U | 1/2020 |
| CN | 212820615 | U | 3/2021 |
| WO | WO 02/083995 | A1 | 10/2002 |

ELECTROPLATING CONDUCTIVE FIXTURE

TECHNICAL FIELD

The present invention relates to the field of electroplating technologies, in particular to an electroplating conductive fixture.

BACKGROUND

An electroplating process is generally applied in a molding process of metal bumps, and enables the bumps to grow within a pane formed by photoresist. In the electroplating process, a substrate is placed in an electroplating bath, and a surface of a pad is covered with a metal layer by utilizing a reaction of electrodes, such that the bumps are finally formed.

The electroplating process is widely applied in the field of electronics manufacturing. The existing electroplating processes are mainly implemented by means of an electroplating machine which is equipped with a conductive fixture and a conductive piece. The existing conductive fixture is generally a post-shaped conductive wire and is in electrical contact with the conductive piece, whereas the conductive piece is placed in a plating bath. Due to the characteristics of the plating bath itself, the conductive piece immersed in the plating bath is prone to crystallization, so that the conductive fixture can be in poor contact with the conductive piece, causing abnormality to a current and a voltage.

SUMMARY

The technical problem solved by the present application is to provide an electroplating conductive fixture to improve the problem of poor contact between the conductive piece and the conductive fixture due to crystallization in the prior art.

In order to solve the technical problem, the present application provides an electroplating conductive fixture. The electroplating conductive fixture includes: a base, a top cover cooperating with the base, an accommodating cavity provided between the base and the top cover, and a lifting-type conductive column accommodated in the accommodating cavity, wherein a bottom end of the conductive column runs downward through the base and extends out of the accommodating cavity;

the base is provided with a first guide part, and the conductive column is provided with a second guide part which cooperates with the first guide part, wherein at least one of the first guide part and the second guide part extends in a bottom-up spiral shape; and a scraper is provided at the bottom end of the conductive column; and the bottom end of the conductive column, when acted by an external force, moves towards the accommodating cavity; and the conductive column rotates in the movement process under an interaction between the first guide part and the second guide part, and moves so as to be restored after the external force is withdrawn.

Further, the accommodating cavity includes an upper cavity body and a lower cavity body that are formed on the base, and the first guide part is formed on an inner wall surface of the lower cavity body and protrudes into the lower cavity body.

Further, the lower cavity body runs downward through a bottom surface of the base and forms a lower opening in this bottom surface; and the first guide part is a protruding rib extending in a spiral shape and extends from top to bottom to a position of the lower opening.

Further, the conductive column is provided with an upper cylinder body accommodated in the upper cavity body and a lower cylinder body accommodated in the lower cavity body; and the second guide part is a groove that extends in a spiral shape, and is formed on a circumferential surface of the lower cylinder body and extends from top to bottom.

Further, the conductive column is provided with an upper cylinder body, a lower cylinder body, an abutment seat connected between the upper cylinder body and the lower cylinder body, and a spring sleeving the upper cylinder body; and an annular supporting portion is formed at the bottom of the upper cavity body and supports the abutment seat upward, and the abutment seat supports the spring upward.

Further, the conductive column further includes a retractable guide rod accommodated in the upper cylinder body and the lower cylinder body, and an elastic member sleeves the retractable guide rod and is accommodated in the lower cylinder body.

Further, an accommodating groove and a through hole are formed in the lower cylinder body; the elastic member is accommodated in the accommodating groove; the through hole extends downward and penetrates to an end surface of the bottom of the conductive column; a bottom end of the retractable guide rod is accommodated in the through hole; and a top end of the retractable guide rod extends upward and protrudes to a top surface of the upper cylinder body.

Further, the scraper includes three scraping strips, and the three scraping strips are formed as a trident star in shape; and a width of each scraping strip gradually decreases in a radial direction from inside to outside.

Further, the bottom end of the conductive column is provided with a circular bottom surface, and the scraper extends in a straight line and runs through a center of the circular bottom surface.

An electroplating conductive fixture includes a base and a lifting-type conductive column mounted within the base, wherein the conductive column and the base cooperate with each other via a guide portion having a spiral shape, such that the conductive column rotates while being lifted; and a bottom end of the conductive column is provided with a scraper exposed below the base.

Compared with the prior art, the present application involves providing on the base and the conductive column the first guide part and the second guide part that are in the spiral shape and cooperate with each other, such that the conductive column can be driven to rotate forward and reversely each time the electroplating conductive fixture is lifted up or placed down, and the scraper at the bottom end of the conductive column can be used to clean crystals on the conductive piece, thereby ensuring good contact between the conductive column and the conductive piece and improving the stability of a current and a voltage.

DETAILED DESCRIPTION

Figure 1:
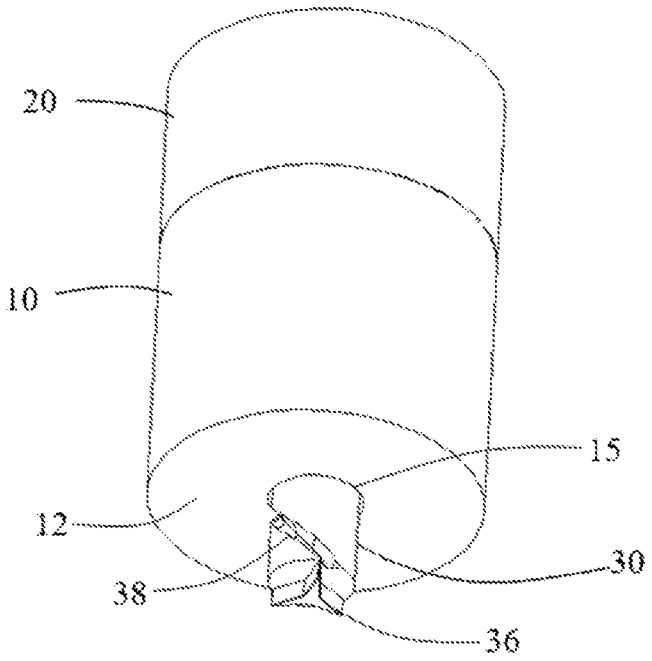
FIG. 1 is a three-dimensional diagram of an electroplating conductive fixture according to a first embodiment of the present application.
Figure 2:
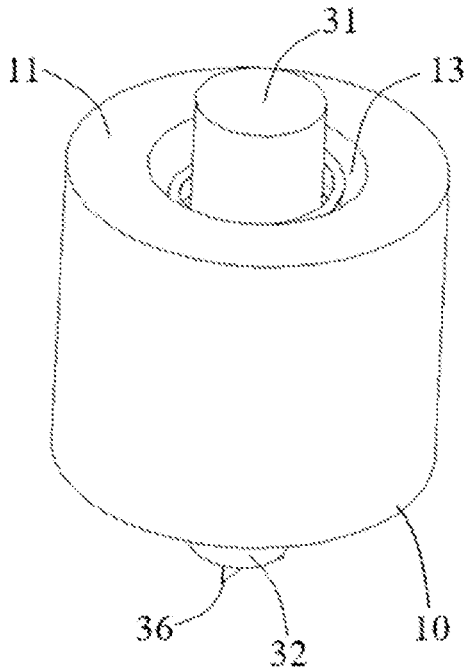
FIG. 2 is a schematic diagram of assembling of a base and a conductive column of the electroplating conductive fixture according to the first embodiment of the present application.

The embodiments described below with reference to the accompanying drawings are exemplary, and are intended to explain the present invention and shall not be explained as a limitation to the present invention.

First Embodiment

FIGS. 1 to 7 show a first embodiment of the present application, in which an electroplating conductive fixture 100 is provided. The electroplating conductive fixture 100 includes a base 10, atop cover 20, and a conductive column 30 accommodated in the base 10. A bottom end of the conductive column 30 protrudes downward out of the base 10, is used to abut against and contact a conductive piece 200, and is further provided with at least one scraper 36. When the conductive column 30 abuts against the conductive piece 200, the conductive column 30 moves upward in a retractable way due to an abutting pressure, and rotates at the same time, such that the scraper 36 can scrape the surface of the conductive piece 200 to scrape away crystals on the surface of the conductive piece 200, thereby ensuring stable and reliable electrical contact between the conductive column 30 and the conductive piece 200.

Figure 3:
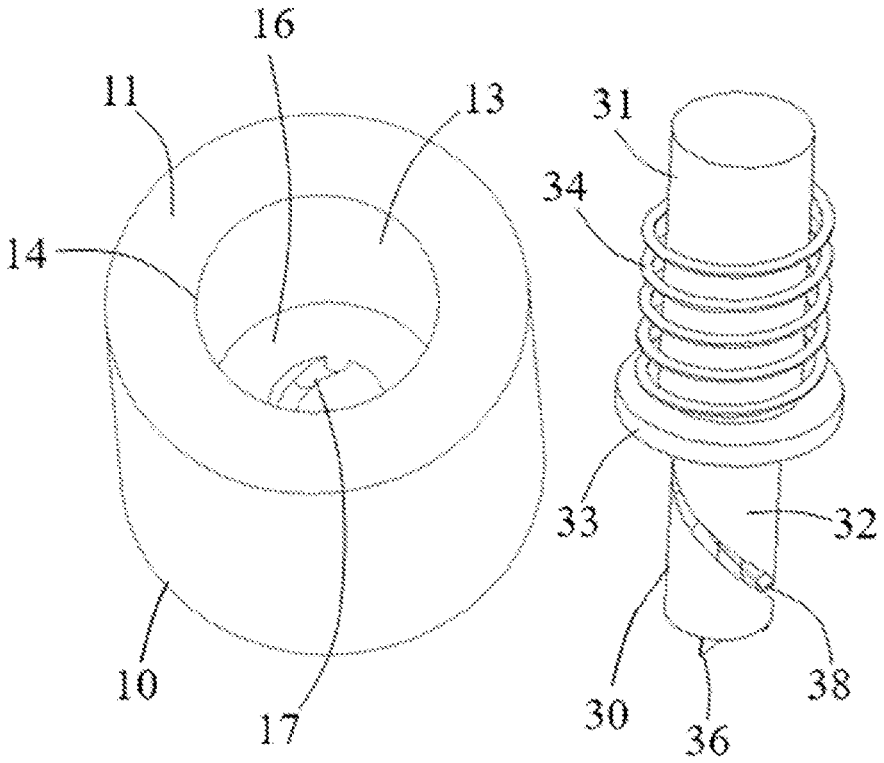
FIG. 3 is an exploded view of the electroplating conductive fixture according to the first embodiment of the present application.
Figure 4:
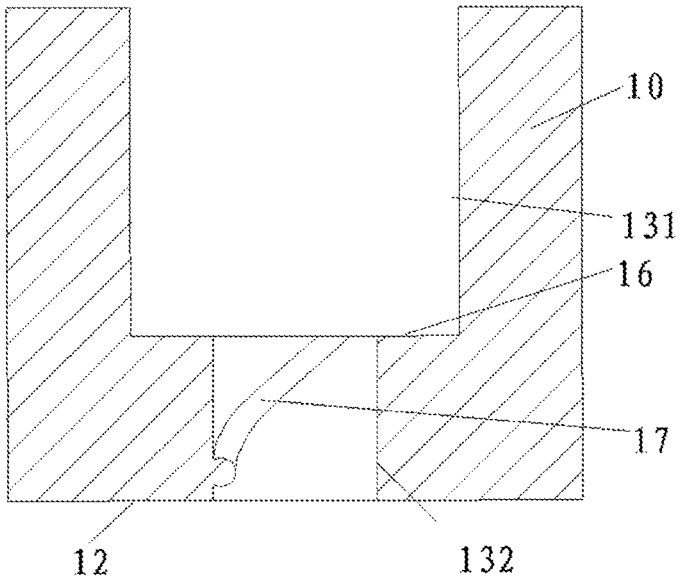
FIG. 4 is a schematic diagram of an internal structure of the base of the electroplating conductive fixture according to the first embodiment of the present application.
Figure 5:
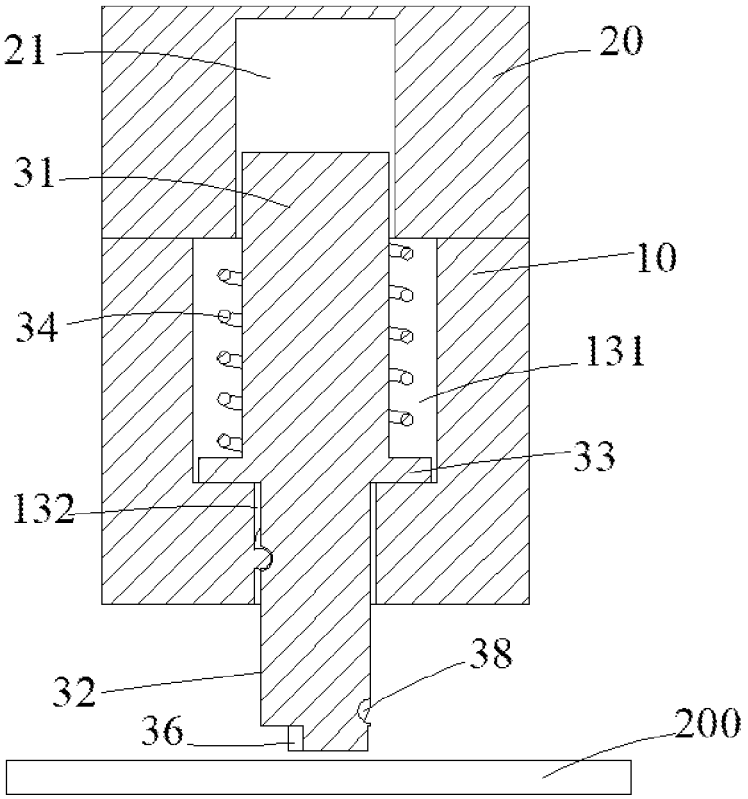
FIG. 5 is a schematic diagram of an internal structure of the electroplating conductive fixture according to the first embodiment of the present application.

The base 10 is cylindrical and is provided with a top surface 11, a bottom surface 12 and an accommodating cavity 13 between the top surface 11 and the bottom surface 12. The accommodating cavity 13 runs vertically through the top surface 11 and the bottom surface 12, and an upper opening 14 and a lower opening 15 are formed in the top surface 11 and the bottom surface 12, respectively. The upper opening 14 and the lower opening 15 are preferably circular in shape, and the size of the upper opening 14 is larger than the size of the lower opening 15. The accommodating cavity 13 is provided with a supporting portion 16 inside. The supporting portion 16 is preferably an annular supporting portion. The supporting portion 16 is configured to support the conductive column 30 upward. It is worth mentioning that the presence of the supporting portion 16 causes the accommodating cavity 13 to be divided into upper and lower portions, i.e., an upper cavity body 131 and a lower cavity body 132, respectively. As shown in FIG. 3, the upper cavity body 131 corresponds to the upper opening 14, and the lower cavity body 132 corresponds to the lower opening 15. Specifically, the upper cavity body 131 runs upward through the top surface 11 to form the upper opening 14, while the lower cavity body 132 runs downward through the bottom surface 12 to form the lower opening 15. The supporting portion 16 is located at the bottom of the upper cavity body 131, while the lower cavity body 132 is located at an inner side of the supporting portion 16. Preferably, the lower cavity body 132 is located in a center region of the supporting portion 16, and a first guide part 17 is formed on an inner wall surface of the lower cavity body 132. The first guide part 17 extends in a curved shape from top to bottom to the position of the lower opening 15, and the first guide part 17 is configured to cooperate with the conductive column 30 to guide the conductive column 30 to realize upward and downward movements.

The top cover 20 of the electroplating conductive fixture 100 is also cylindrical and covers the base 10 to seal the conductive column 30 on the inner side. In addition, the top cover 20 is also provided with a make-way cavity 21 for providing a make-way space for the upward movement of the conductive column 30, so as to facilitate retractable upward and downward movements of the conductive column 30.

The conductive column 30 includes an upper cylinder body 31, a lower cylinder body 32, an abutment seat 33 connected between the upper cylinder body 31 and the lower cylinder body 32, and a spring 34 sleeving the upper cylinder body 31. The upper cylinder body 31 and the lower cylinder body 32 are both cylindrical, the upper cylinder body 31 is thicker than the lower cylinder body 32, and the upper cylinder body 31, the lower cylinder body 32 and the abutment seat 33 are formed as an integer. The upper cylinder body 31, the abutment seat 33 and the spring 34 are all accommodated in the upper cavity body 131 of the accommodating cavity 13. A top end of the upper cylinder body 31 protrudes upward out of the upper cavity body 131 and into the make-way cavity 21 of the top cover 20. The lower cylinder body 32 is accommodated in the lower cavity body 132, and a bottom end of the lower cylinder body 32 protrudes downward out of the lower cavity body 132. The lower cylinder body 32 is configured to abut against the conductive piece 200, the abutment seat 33 is circular in shape, and the abutment seat 33 protrudes from circumferential surfaces of the upper cylinder body 31 and the lower cylinder body 32. The abutment seat 33 is configured to be supported on the supporting portion 16, so as to limit the upward and downward movements of the conductive column 30 in a vertical direction. The spring 34 sleeves the upper cylinder body 31, the bottom of the spring 34 directly abuts against the abutment seat 33, and the top of the spring 34 directly abuts against the top cover 20. It is to be particularly noted that the bottom end of the lower cylinder body 32 is further provided with a circular bottom surface 35, and the circular bottom surface 35 is provided with a scraper 36 that abuts against the conductive piece 200. Preferably, the scraper includes three scraping strips 37, and the three scraping strips 37 are provided as a trident star in shape and are evenly distributed along a circumferential direction of the circular bottom surface 35. The three scraping strips 37 are integrally connected, and each of the scraping strips 37 extends in a straight line and runs through a center of the circular bottom surface 35. The width of each scraping strip 37 is designed to change gradually, and gradually become narrower in a direction away from the center of the circular bottom surface 35. That is, the width of the scraping strip 37 gradually decreases in a radial direction from inside to outside.

In order to enable the conductive column 30 to move vertically smoothly, in this embodiment, a second guide part 38 is provided on a circumferential surface of the lower cylinder body 32, and the second guide part 38 extends upward from the circular bottom surface 35 all the way to the top end of the lower cylinder body 32. In order to correspond to the first guide part 17, the second guide part 38 also extends in a curved shape from bottom to top, and thereby can cooperate with the first guide part 17, as shown in FIGS. 6 and 7.

Figure 6:
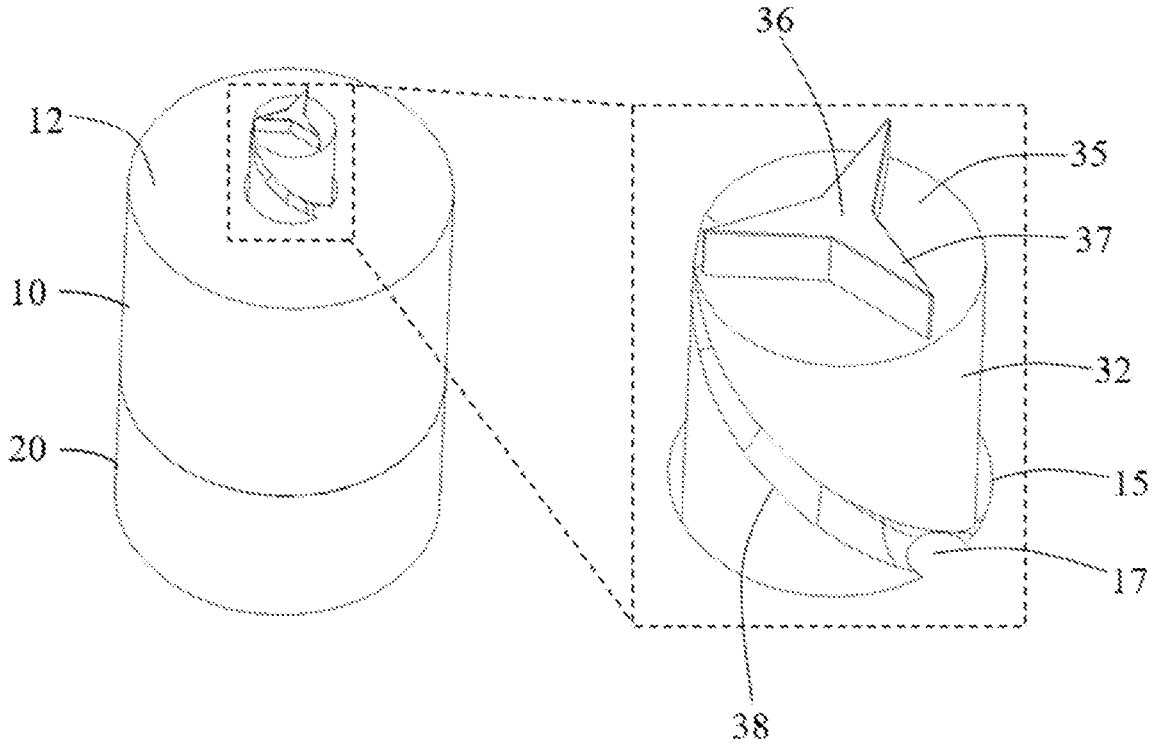
FIG. 6 is a schematic structural diagram when the bottom of the electroplating conductive fixture according to the first embodiment of the present application faces upward.
Figure 7:
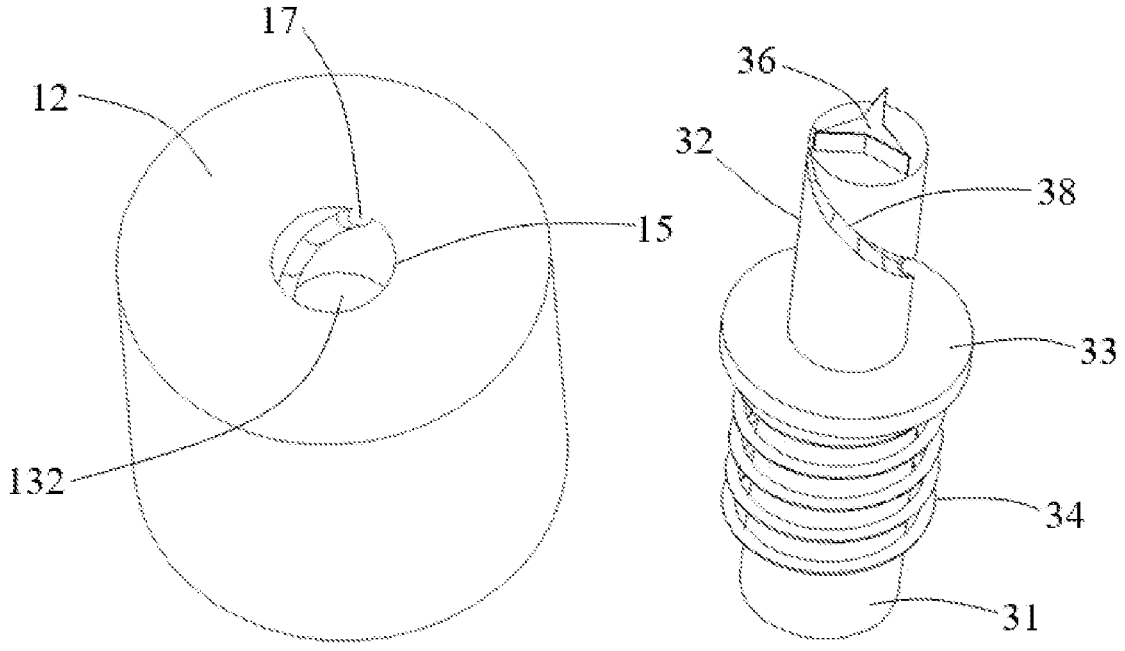
FIG. 7 is a schematic diagram when the base and the bottom of the conductive column in the electroplating conductive fixture according to the first embodiment of the present application face upward.
Figure 8:
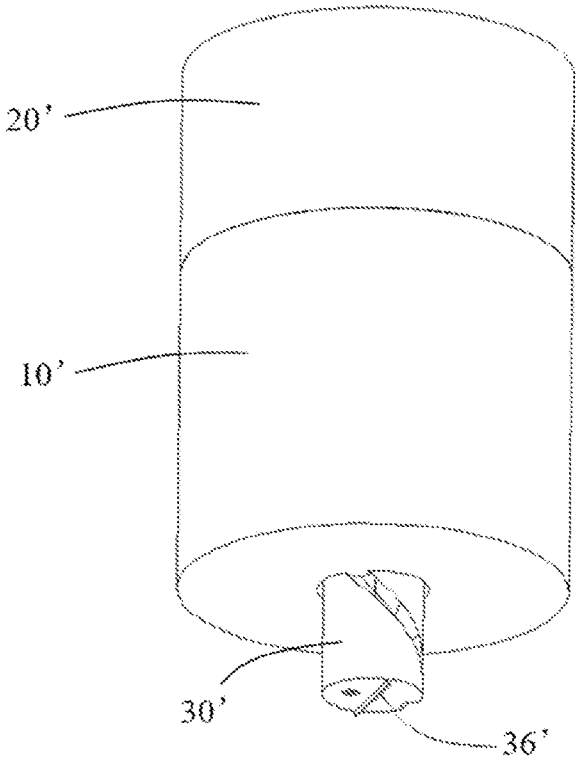
FIG. 8 is a three-dimensional diagram of an electroplating conductive fixture according to a second embodiment of the present application.
Figure 9:
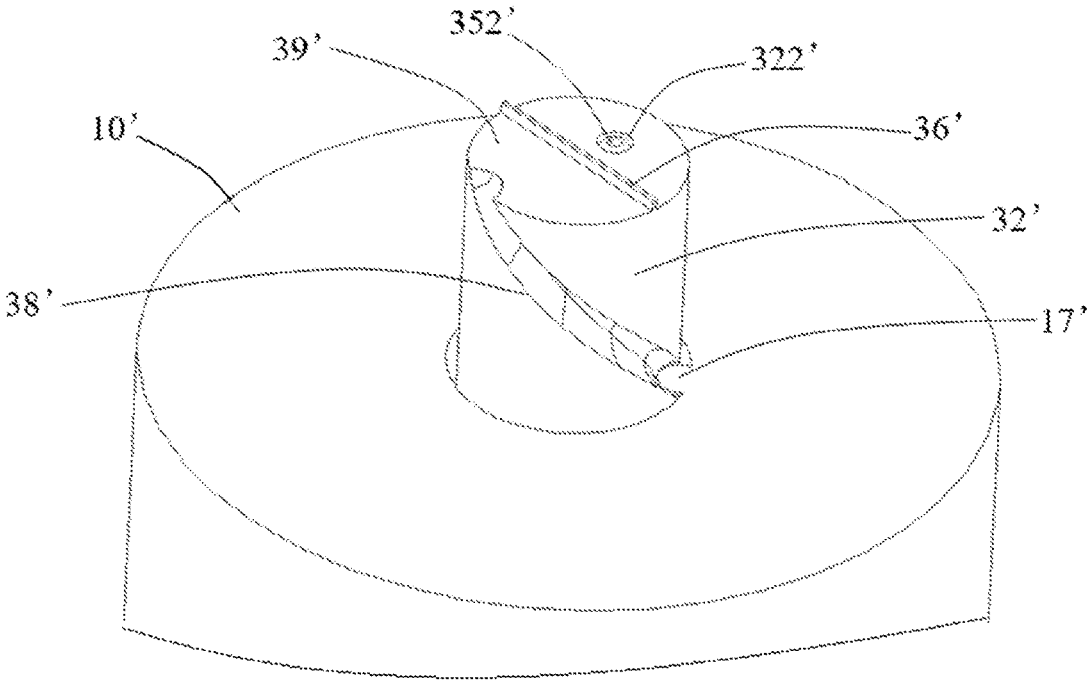
FIG. 9 is a partial schematic diagram when the bottom of the electroplating conductive fixture according to the second embodiment of the present application faces upward.
Figure 10:
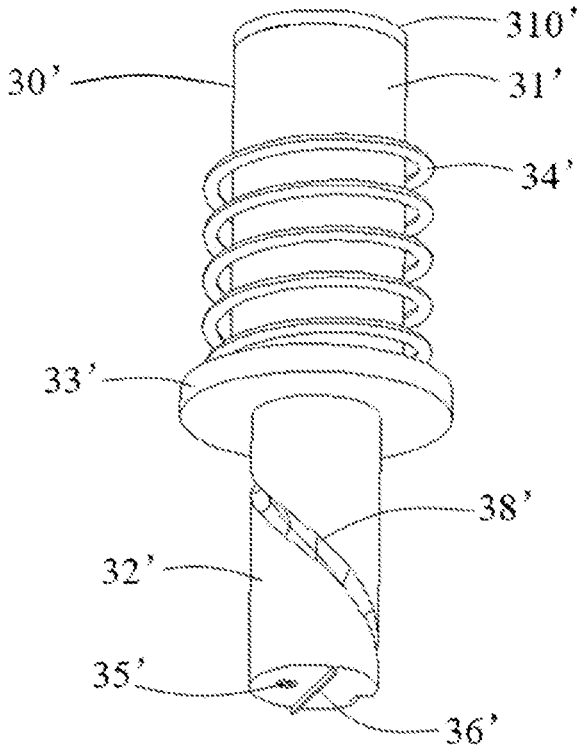
FIG. 10 is a three-dimensional diagram of a conductive column of the electroplating conductive fixture according to the second embodiment of the present application.
Figure 11:
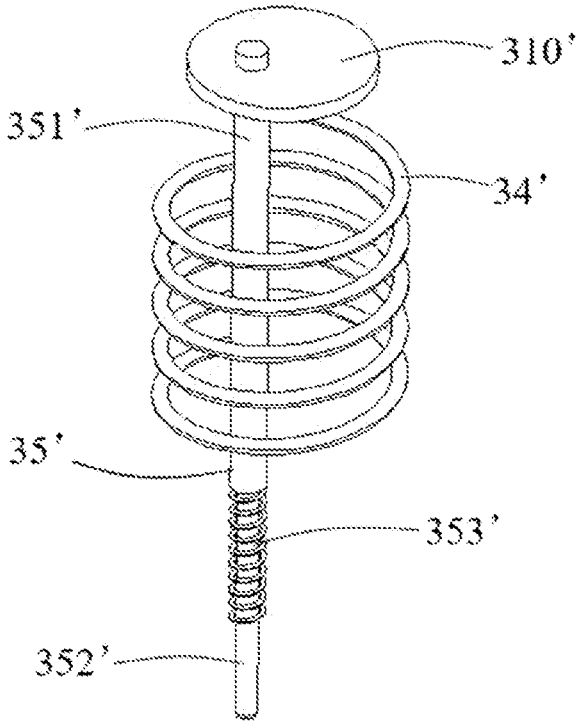
FIG. 11 is a schematic diagram of a retractable guide rod of the electroplating conductive fixture according to the second embodiment of the present application.
Figure 12:
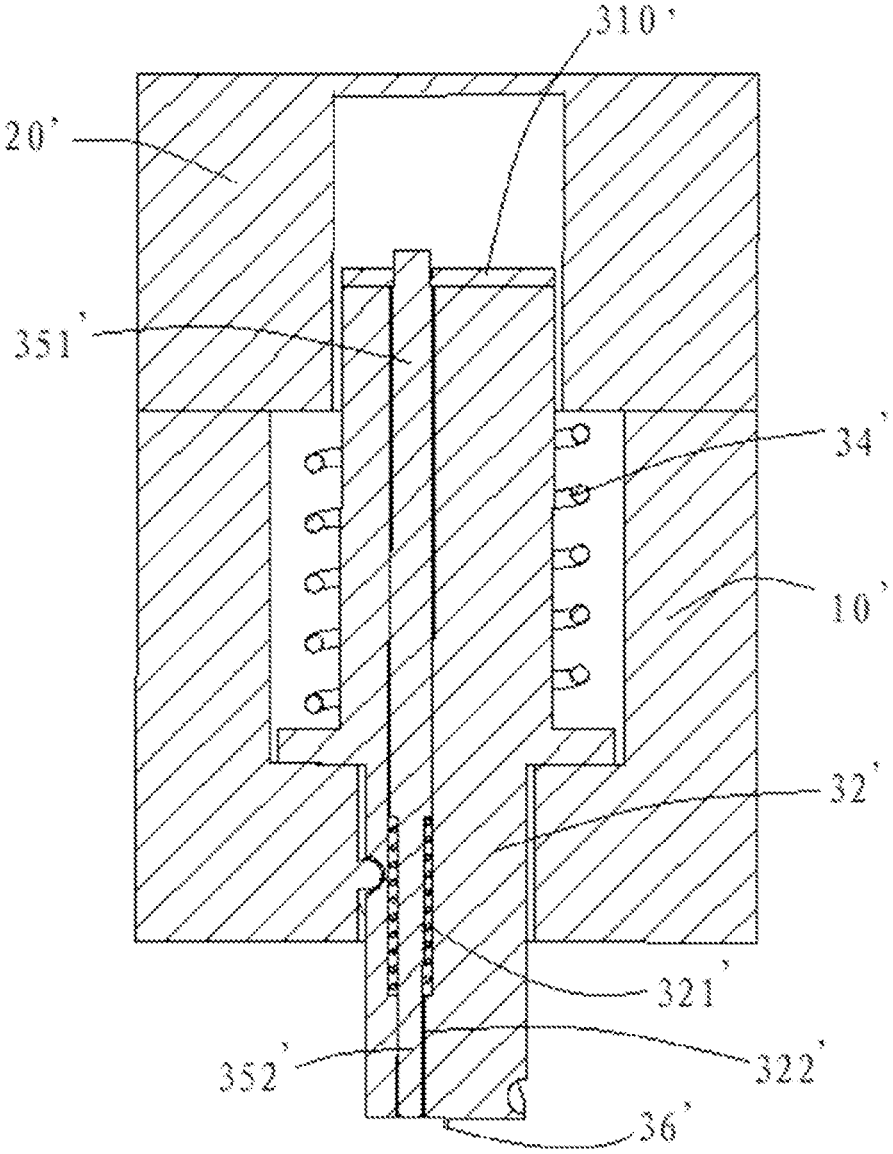
FIG. 12 is a schematic diagram of an internal structure of the electroplating conductive fixture according to the second embodiment of the present application.

Conjunction with FIG. 6, in practice, during the lowering of the electroplating conductive fixture, when the bottom end of the conductive column 30 presses against the conductive piece 200, the conductive column 30 is subjected to an upward pushing action. Due to the guidance under the mutual cooperation between the first guide part 17 and the second guide part 38, the bottom end of the conductive column 30 can smoothly move upward towards the accommodating cavity in the base 10. At this point, the spring 34 is compressed upward. Since the first guide part 17 and the second guide part 38 are both designed to extend in a spiral curve, the conductive column 30 can also rotate while moving upward. That is, under an external force, the conductive column 30 implements a spiral upward movement under the action of the first guide part 17 and the second guide part 38, which in turn enables the scraper 36 at the bottom end of the lower cylinder body 32 of the conductive column 30 to rotate simultaneously. Then, the rotating scraper 36 can effectively scrape and sweep the surface of the conductive piece 200, so as to remove crystals or dirt from the surface of the conductive piece 200. After the withdrawal of the external force, the conductive column 30 moves so as to be restored. Due to the presence of the spring 34, the conductive column 30 can be restored on its own when the electroplating conductive fixture is lift, and the bottom end of the conductive column 30 rotates while moving downward during the restoration process. Thus, during the lifting movement of the conductive column 30, the scraper 36 at the bottom end of the conductive column 30 will rotate forward and reversely.

Second Embodiment

FIGS. 8 to 12 show a second embodiment of the present application, in which the electroplating conductive fixture 100' operates in a manner similar to the first embodiment. That is, a conductive column 30' is pressed downward onto the conductive piece 200 to force a bottom end of the conductive column 30' to rotate, and a scraper 36' at the bottom end of the conductive column 30' is used to scrape and sweep the surface of the conductive piece 200, thereby removing crystals or dirt from the surface of the conductive piece 200. It should be noted that, except for the conductive column 30', the structures of a base 10' and a top cover 20' in the second embodiment are the same as those in the first embodiment. Therefore, only the structure of the conductive column 30' in the second embodiment is described in detail below.

The conductive column 30' is provided with an upper cylinder body 31', a lower cylinder body 32', an abutment seat 33' connected between the upper cylinder body 31' and the lower cylinder body 32', a spring 34' sleeving the upper cylinder body 31', and a retractable guide rod 35' running through the interiors of the upper cylinder body 31' and the lower cylinder body 32'. The upper cylinder body 31' is provided with a circular cover plate 310' at the top, a bottom end of the lower cylinder body 32' protrudes downward out of the base 10', and a second guide part 38' is also provided on a circumferential surface of the lower cylinder body 32'. The second guide part 38' is configured to cooperate with the first guide part 17' in the base 10', and the first guide part 17' and the second guide part 38' both extend curvilinearly, such that the mutual cooperation between the first guide part 17' and the second guide part 38' can force the lower cylinder body 32' to undergo a rotational movement (which is same as in the first embodiment and will not be repeated). The lower cylinder body 32' is further provided with an accommodating groove 321' and a through hole 322' inside, and the through hole 322' is in communication with the accommodating groove 321'. The through hole 322' extends downward from the bottom of the accommodating groove 321' and runs through to a circular bottom surface 39' of the lower cylinder body 32'. A top end of the retractable guide rod 35' runs upward through the cover plate 310' and protrudes over the surface of the cover plate 310'. The retractable guide rod 35' is provided with an elongated rod body 351' and an elongated rod tip 352'. The rod body 351' is thicker than the rod tip 352', and a top end of the rod body 351' runs upward through the cover plate 310' and is exposed on the surface of the cover plate 310'. The rod body 351' runs from top to bottom through the upper cylinder body 31' and protrudes into the accommodating groove 321' in the lower cylinder body 32'. The rod tip 352' further extends downward from the bottom end of the rod body 351' into the through hole 322'. In addition, the surface of the rod tip 352' is also sleeved with an elastic member 353'. The elastic member 353' is accommodated in the accommodating groove 321' and is preferably a spring, the top end of which abuts upward against the rod body 351' and the bottom end of which abuts downward against a bottom wall of the accommodating groove 321'.

In addition, the circular bottom surface of the lower cylinder body 32' is also provided with a scraper 36' having a linear shape, which is different from the trident star structure in the first embodiment. The scraper 36' in the linear shape runs through a center point of the circular bottom surface 39', and both ends of the scraper 36' extend to a circumferential edge of the circular bottom surface 39', such that the scraper 36' in the linear shape has a rather long length and thereby facilitates a scraping effect.

In actual operations, the top end of the retractable guide rod 35' (i.e., the top end of the rod body 351') can be pressed to force the bottom end of the retractable guide rod 35' (i.e., the bottom end of the rod tip 352') to protrude downward out of the through hole 322' and be exposed to the bottom surface of the lower cylinder body 32', thereby contacting the conductive piece 200. When a pressure on the top end of the retractable guide rod 35' is relieved, the bottom end of the retractable guide rod 35' will retract back into the through hole 322' under the action of the elastic member 353', thereby disconnecting the contact with the conductive piece 200.

Thus, compared to the first embodiment, the second embodiment of the present application resides in that the retractable guide rod 35' is provided inside the conductive column 30', and the accommodating groove 321' and the through hole 322' are formed in the lower cylinder body 32'. In addition, two rebound elements, which are the spring 34' and the elastic member 353', are used to assist in the downward probing and retraction of the conductive column 30' for implementing pressing and restoring Moreover, the retractable guide rod 35 built in the conductive column 30' can be pressed to extend downward after the scraper 36' scraps off the crystals, and thereby can abut against the conductive piece 200 to achieve a better conductivity effect.

Preferably, the first guide part 17 in the first embodiment, the first guide part 17' in the second embodiment, the second guide part 38 in the first embodiment, and the second guide part 38' in the second embodiment are preferred to extend from bottom to top in a spiral curve manner. The first guide parts 17 and 17' can be protruding ribs extending in a spiral curve, whereas the second guide parts 38 and 38' can be corresponding grooves that extend in a spiral curve. The combination of the protruding ribs and the grooves can achieve a matching effect similar to the matching between a sliding groove and a sliding rail. Of course, the first guide parts 17 and 17' can each also be designed as only a bump provided on an inner surface of the lower cavity body, rather than an elongated protruding rib extending in a spiral curve. The bump can also be clamped in the groove (i.e., the second guide parts 38, 38') and slide in a curved manner within the groove, driving the lower cylinder body to rotate and enabling the scrapers 36, 36' to rotate. In other words, at least one of the first guide parts 17, 17' and the second guide parts 38, 38' can extend in a spiral shape. Moreover, the positions of the grooves and the protruding ribs can also be interchanged.

In summary, whether in the first embodiment or the second embodiment, the structures of the electroplating conductive fixtures 100 and 100' are optimized in the present application by providing on the base and the conductive column the first guide parts 17, 17' and the second guide parts 38, 38' that extend in the spiral shape and cooperate with each other, such that the conductive columns 30 and 30' can be driven to rotate forward and reversely each time the electroplating conductive fixtures 100 and 100' are lifted up or placed down, such that the scrapers 36 and 36' at the bottom ends of the conductive columns 30 and 30' can be used to clean the crystals on the conductive piece 200, thereby ensuring good contact between the conductive piece 200 and the conductive columns 30 and 30' and improving the stability of a current and a voltage.

The embodiments as shown by the figures detail the structures, features, and effects of the present invention. The above embodiments are only preferred embodiments of the present invention, but the scope of implementation of the present invention is not limited by the figures. Any changes made according to the concept of the present invention or equivalent embodiments as amended with equivalent changes, when not going beyond the spirit covered by the specification and figures, shall fall within the protection scope of the present invention.

What is claimed is:

1. An electroplating conductive fixture, comprising: a base, a top cover cooperating with the base, an accommodating cavity provided between the base and the top cover, and a lifting-type conductive column accommodated in the accommodating cavity, wherein a bottom end of the conductive column runs downward through the base and extends out of the accommodating cavity;

the base is provided with a first guide part, and the conductive column is provided with a second guide part which cooperates with the first guide part, wherein at least one of the first guide part and the second guide part extends in a bottom-up spiral shape; and a scraper is provided at the bottom end of the conductive column; and the bottom end of the conductive column, when acted by an external force, moves towards the accommodating cavity; and the conductive column rotates in the movement process under an interaction between the first guide part and the second guide part, and moves so as to be restored after the external force is withdrawn.

2. The electroplating conductive fixture according to claim 1, wherein the accommodating cavity comprises an upper cavity body and a lower cavity body that are formed on the base, and the first guide part is formed on an inner wall surface of the lower cavity body and protrudes into the lower cavity body.

3. The electroplating conductive fixture according to claim 2, wherein the lower cavity body runs downward through a bottom surface of the base and forms a lower opening in the bottom surface; and the first guide part is a protruding rib extending in a spiral shape and extends from top to bottom to a position of the lower opening.

4. The electroplating conductive fixture according to claim 3, wherein the conductive column is provided with an upper cylinder body accommodated in the upper cavity body and a lower cylinder body accommodated in the lower cavity body; and the second guide part is a groove that extends in a spiral shape, and is formed on a circumferential surface of the lower cylinder body and extends from top to bottom.

5. The electroplating conductive fixture according to claim 2, wherein the conductive column is provided with an upper cylinder body, a lower cylinder body, an abutment seat connected between the upper cylinder body and the lower cylinder body, and a spring sleeving the upper cylinder body; and an annular supporting portion is formed at the bottom of the upper cavity body; the supporting portion supports the abutment seat upwards, and the abutment seat supports the spring upward.

6. The electroplating conductive fixture according to claim 5, wherein the conductive column further comprises a retractable guide rod accommodated in the upper cylinder body and the lower cylinder body, and an elastic member sleeves the retractable guide rod and is accommodated in the lower cylinder body.

7. The electroplating conductive fixture according to claim 6, wherein an accommodating groove and a through hole are also formed inside the lower cylinder body; the elastic member is accommodated in the accommodating groove, the through hole extends downward and penetrates to an end surface of the bottom of the conductive column; a bottom end of the retractable guide rod is accommodated in the through hole; and a top end of the retractable guide rod extends upward and protrudes to a top surface of the upper cylinder body.

8. The electroplating conductive fixture according to claim 1, wherein the scraper comprises three scraping strips, and the three scraping strips are formed as a trident star in shape; and a width of each scraping strip gradually decreases in a radial direction from inside to outside.

9. The electroplating conductive fixture according to claim 1, wherein the bottom end of the conductive column is provided with a circular bottom surface, and the scraper extends in a straight line and runs through a center of the circular bottom surface.

10. An electroplating conductive fixture, comprising a base and a lifting-type conductive column mounted within the base, wherein the conductive column and the base cooperate with each other via a guide portion having a spiral shape, such that the conductive column rotates while being lifted; and a bottom end of the conductive column is provided with a scraper exposed below the base.

* * * * *